US005657863A

United States Patent [19]

Olsen

[11] Patent Number: 5,657,863

[45] Date of Patent: Aug. 19, 1997

[54] WELDED CARRIER DEVICE

[75] Inventor: Robert C. Olsen, Madinah, Ill.

[73] Assignee: Illinois Tool Works Inc., Glenview, Ill.

[21] Appl. No.: 529,527

[22] Filed: Sep. 18, 1995

[51] Int. Cl.[6] ..... B65D 71/00

[52] U.S. Cl. ..... 206/150; 206/162; 294/87.2

[58] Field of Search ..... 206/150, 158, 206/162, 161, 199; 220/DIG. 29; 383/107; 294/87.2

[56] References Cited

U.S. PATENT DOCUMENTS

| | | | |
|---|---|---|---|
| 2,650,128 | 8/1953 | Failor . | |
| 2,680,038 | 6/1954 | Gray . | |
| 2,719,100 | 9/1955 | Banigan . | |
| 2,874,835 | 2/1959 | Poupitch . | |
| 2,994,426 | 8/1961 | Biesecker et al. . | |
| 3,191,849 | 6/1965 | Gutowski et al. . | |
| 3,204,386 | 9/1965 | Creed et al. . | |
| 3,307,321 | 3/1967 | Beart . | |
| 3,314,591 | 4/1967 | Cheeley . | |
| 3,383,827 | 5/1968 | Schaich . | |
| 3,608,949 | 9/1971 | Owen . | |
| 3,738,698 | 6/1973 | Helms . | |
| 3,744,704 | 7/1973 | Struble . | |
| 3,868,140 | 2/1975 | Gordon . | |
| 4,103,811 | 8/1978 | Owen . | |
| 4,250,682 | 2/1981 | Braun . | |
| 4,919,260 | 4/1990 | Cunningham . | |
| 5,437,364 | 8/1995 | Broskow | 206/150 |
| 5,487,465 | 1/1996 | Broskow | 206/150 |

*Primary Examiner*—Bryon P. Gehman

*Attorney, Agent, or Firm*—Trexler, Bushnell, Giangiorgi & Blackstone, Ltd.

[57] ABSTRACT

A plastic carrier device for carrying a plurality of containers, such as bottles, cans and the like, has container engaging portions; each of which is formed from a sheet of plastic material and includes bands which define apertures therein for engaging the side walls of the containers to form a package. Each container engaging portion has a top margin and opposite side margins. A joined portion is formed at the top margins by bonding the top margins together for joining the container engaging portions together such that the portions freely extend downwardly from the joined portion. The bonded joined portion is continuous along its length. A notch portion is provided along the side margins of each of the container engaging portions and is downwardly of the joined portion to relieve the amount of stress placed on the ends of the joined portion when the bands are stretched over the containers by a jaw stretching machine. A plurality of cutouts are provided in each container engaging portion downwardly of the joined portion and are between adjacent apertures in the portions.

9 Claims, 1 Drawing Sheet

WELDED CARRIER DEVICE

BACKGROUND OF THE INVENTION

This invention is generally directed to improvements to a novel plastic carrier device for carrying containers such as bottles, cans and the like. More particularly, the invention contemplates improvements to a novel plastic carrier device which includes two container carrying portions that can be stretched over the containers and further includes a continuous joined portion between the two container carrying portions, such joined portion being formed by welding or bonding the top margins of the container engaging portions together.

The majority of container carriers today are preferably formed from a plastic material due to the ease and lower cost of manufacturing and the strength of the material. The carriers have a plurality of bands which define apertures therein, each of which holds a single container therein. To apply the carrier to the containers, the bands of the carrier are stretched over the containers by a jaw stretching machine.

U.S. patent application Ser. No. 08/489,339 filed on Jun. 12, 1995 and entitled "Top Lift Container Carrier With Extendable Handle", discloses such a carrier. The plastic carrier has two container engaging portions which are joined to each other along adjacent edges by a discontinuous weld or joined portion. Each container engaging portion has a plurality of bands which define apertures therein, each of which holds a single container to form a package. To apply the carrier to the containers, the bands of the carrier are stretched over the containers by a jaw stretching machine. Because the stretching forces on traditional jaw stretching machines are high, the joined portion of the carrier has a tendency to peel at the edges of the joined portion.

In addition, the carrier disclosed in U.S. patent application Ser. No. 08/489,339 is provided with a plurality of cutouts which interrupt the length of the joined portion to aid in permitting the carrier to be stretched over the containers. The cutouts contract longitudinally when the carrier is stretched laterally over the containers. Since the joined portion is discontinuous along its length, when a line of carriers, before they are separated into individual carriers, are wound on a reel or a roll, the edges of the cutouts tend to interlock with each other which makes the handling of the carriers difficult.

The present invention presents a novel carrier device which is intended to present several improvements to the carrier disclosed in U.S. patent application Ser. No. 08/489,339 as well as to present several other advantages.

OBJECTS AND SUMMARY OF THE INVENTION

A general object of the present invention is to provide a novel plastic carrier device for carrying containers, such as bottles or cans and the like.

An another object of the present invention is to provide a novel plastic carrier device that includes a welded or bonded joined portion between container engaging portions, and which further includes a notch portion proximate to the ends of the joined portion, each such notch portion relieving the amount of stress on the ends of the bonded joined portion to prevent the ends of the joined portion from peeling apart when the carrier device is applied over a plurality of containers.

Yet another object of the present invention is to provide a plastic carrier device which has container engaging portions which extend freely from a welded or bonded joined portion, such joined portion being continuous along its length to provide for ease in winding a line of carrier devices onto a reel or a roll before they are separated into individual carrier devices.

A further object of the present invention is to provide a novel carrier device having a plurality of cutouts therein which allow the carrier device to be stretched laterally over a plurality of containers, such cutouts contracting longitudinally when the carrier device is stretched laterally.

Briefly, and in accordance with the foregoing, the present invention discloses a novel plastic carrier device for carrying containers, such as bottles, cans and the like. The carrier device has container engaging portions, each of which is formed out of a sheet of plastic material and each of which includes bands which define apertures for engaging the side walls of the containers to hold the containers therein to form a package. Each container engaging portion has a top margin, a bottom margin and opposite side margins. A joined portion is formed at the top margins by welding or bonding the plastic sheets together to join the container engaging portions together such that the portions freely extend downwardly from the joined portion. The joined portion is continuous along its length. A plurality of cutouts are provided in each container engaging portion downwardly of the joined portion and are between adjacent apertures in the container engaging portions. A notch portion is provided along each of the side margins of each of the container engaging portions and is downwardly of the joined portion to relieve the amount of stress placed on the ends of the joined portion when the bands are stretched over the containers by a jaw stretching machine. The carrier device may include a handle portion which extends from the joined portion.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
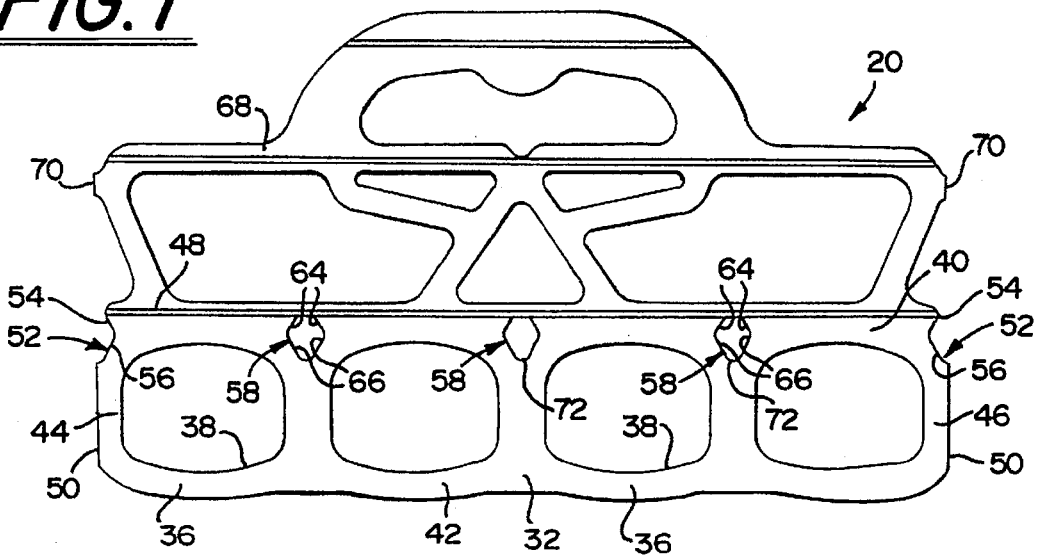
FIG. 1 is a side elevational view of a carrier device which incorporates the features of the invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
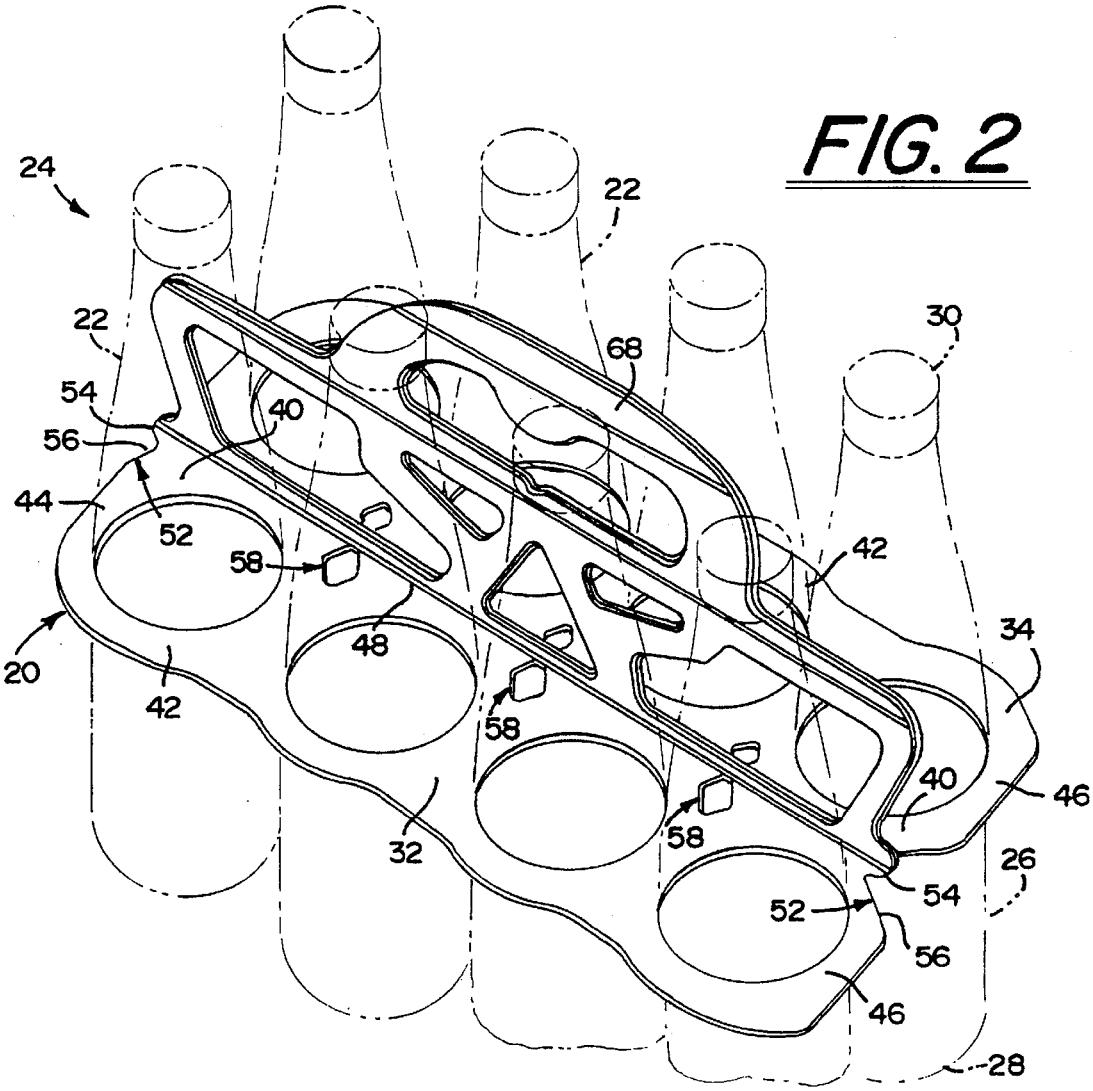
FIG. 2 is a perspective view of the carrier device surrounding a plurality of containers, shown in phantom lines, to form a package.

As shown in FIG. 1, the present invention presents a novel multi-packaging device or carrier device 20. As illustrated in FIG. 2, the novel carrier device 20 of the present invention is used to securely hold a plurality of containers 22, such as bottles, to form a package 24. Each bottle 22 includes a side wall 26, a bottom wall 28 and a top or cap 30. It is to be understood that other types of containers can be carried by the carrier device 20, such as cans and the like.

When the containers 22 are secured in a package arrangement by the carrier device 20, the containers 22 are aligned in an array so to form two rows. As shown in the drawings, each row has four bottles 22. It is to be understood that the carrier device 20 operates equally well with any number of containers 22.

The carrier device 20 is made of a suitable flexible, resilient, stretchable material, such as plastic. Preferably, the carrier device 20 is made of a low density polyethylene. The material is such that the carrier device 20 can be stretched over the containers 22 by a jaw stretching machine and can conform to the side walls 26 of the containers 22. The carrier device 20 may be applied to the containers 22 by known means, for example, by the jaw stretching machines disclosed in U.S. Patent No. 4,250,682 or U.S. Patent No. 3,204,386.

The carrier device 20 includes container engaging portions 32, 34, each formed from a sheet of plastic material. Each container engaging portion 32, 34 includes a plurality of annular rings or bands 36. The annular bands 36 define a plurality of shaped apertures 38 for securely holding the containers 22 therein. Each container engaging portion 32, 34 has a top margin 40, a bottom margin 42 and opposite side margins 44, 46.

The container engaging portions 32, 34 are connected or joined together by a continuous seam or a continuous joined portion 48 along the top margins 40 of each container engaging portion 32, 34. The joined portion 48 runs the length of the container engaging portions 32, 34 such that opposite ends of the joined portion 48 are defined. The container engaging portions 32, 34 freely extend from the joined portion 48. When the carrier device 20 is not assembled with containers 22, the carrier device 20 is flat and the joined portion 48 lies in generally the same plane as the container engaging portions 32, 34. The joined portion 48 projects generally perpendicular to the plane of the container engaging portions 32, 34 when the carrier device 20 is assembled with containers 22.

The joined portion 48 may be formed by extruding a strip or layer of resilient, stretchable material (not shown), such as plastic, preferably low density polyethylene material, between the top margins 40 of the plastic sheet container engaging portions 32, 34 and thereafter sufficiently melting and merging the top margins 40 of the container engaging portions 30, 32 and the layer of extruded plastic together by known means, preferably by heat sealing and fusing the layers together, to form a strong, integral bond. The resulting bond in the joined portion 48 is relatively rigid and non-collapsible relative to the plastic sheet material from which the container engaging portions 32, 34 are formed. Therefore, the overall length of the carrier 20 is substantially fixed by the length of the bonded joined portion 48. A method for forming the multi-package device or carrier device 20 of the present invention is disclosed in U.S. patent application Ser. No. 08/230,308 entitled "Container Carrier" and owned by the assignee herein and which disclosure is incorporated herein by reference.

Each side of each side margins 44, 46 has a straight portion 50 and a notch portion 52. The notch portion 52 is between the joined portion 48 and the straight portion 50 of the side margin 46, 48. The straight portion 50 of each of the side margins 46, 48 defines the outermost extents of the container engaging portions 32, 34.

The notch portion 52 on each side of the side margins 44, 46 is downwardly of the joined portion 48 and upwards of the outermost apertures 38 to provide a stress relief for the outermost ends of the joined portion 48 when the container engaging portions 32, 34 are being stretched over the containers 22 by the jaw stretching machine. Each notch portion 52 is formed by an upper inwardly directed, tapered edge 54 which is joined with a lower inwardly directed, tapered edge 56. The upper edge 54 of each notch portion 52 tapers inwardly from the joined portion 48 to the lower tapered edge 56. The lower tapered edge 56 of each notch portion 52 tapers therefrom outwardly to the straight portion 50 of the respective side margin 44, 46.

When the container engaging portions 32, 34 are stretched over the containers 22 by the jaw stretching machine, the upper and lower edges 54, 56 of the notch portion 52 generally straighten relative to the straight portion 50 to relieve the stress on the outermost ends of the joined portion 48. Since the stretching forces on jaw stretching machines are high, the notch portions 52 avoid the stress from being applied directly to the outermost ends of the joined portion 48 where the joined portion 48 would be susceptible to peel forces. The notch portions 52 also permit the outermost band 36 on each side of the container engaging portions 32, 34 to accept some of the stress in areas substantially all around the outermost aperture 38. This prevents the concentration of stress forces in the side margins 44, 46 which could overstretch the band 36.

Each container engaging portion 32, 34 has a plurality of spaced cutouts 58 therein which form apertures through the container engaging portions 32, 34. The cutouts 58 are spaced along the length of the joined portion 48 and are intermediate adjacent apertures 38. The cutouts 58 are spaced upwardly from the apertures 38, and are adjacent to, but do not interrupt, the joined portion 48. The cutouts 58 aid in permitting the carrier device 20 to be stretched laterally over the containers 22. The cutouts 58 contract longitudinally when the carrier device 20 is stretched laterally over the containers 22 by a jaw stretching machine.

The cutouts 58 are formed from a pair of notch portions 60, 62, each of which is similar in form to the notch portions 52 provided on the side margins 46, 48 of the container engaging portions 32, 34. Specifically, each notch portion 60, 62 is formed by an upper tapered edge 64 and a lower tapered edge 66. The upper edge 64 tapers from the joined portion 48 outwardly towards the respective side margin 44, 46 to the lower tapered edge 66. The lower tapered edge 66 tapers therefrom inwardly to a point 72 which is spaced from the joined portion 48. The notch portions 60, 62 are joined at their lower ends at point 72.

When the container engaging portions 32, 34 are stretched over the containers 22 by the jaw stretching machine, the upper and lower edges 64, 66 of the cutouts 58 generally straighten to contract or narrow the cutouts 58. This permits the portions of the upper margin 40 of the container engaging portions 32, 34 which are between the respective cutouts 58 to stretch as the container engaging portions 32, 34 are stretched over the containers 22 to allow the bands 36 of the container engaging portions 32, 34 to stretch around the containers 22. Since the joined portion 48 is relatively rigid, it does not substantially stretch when the carrier 20 is applied to the containers 22, but the flexible plastic sheet material of which the container engaging portions 32, 34 are formed is able to stretch. In addition, the area along the sides of the bands 36 and the bottom margin 40 of the container engaging portions 32, 34 may also stretch. Moreover, due to the contraction of the cutouts 58, the joined portion 48 is prevented from substantially bunching as the carrier 20 is applied to the containers 22. The joined portion 48 may slightly wrinkle or fold in areas proximate to the cutouts 58, but the bond in the joined portion 48 is strong enough to prevent the layers of the joined portion 48 from shearing.

The carrier device 20 may include an integral handle portion 68 which extends upwardly from the joined portion 48 of the carrier device 20. Such a handle portion 68 is disclosed in U.S. patent application Ser. No. 08/489,339, which disclosure is herein incorporated by reference. When the carrier device 20 is not assembled with containers 22, the carrier device 20 is flat and the handle portion 68 lies in the same plane as the container engaging portions 32, 34. When the carrier device 20 is assembled with containers 22, the handle portion 68 projects generally perpendicular to the plane of the container engaging portions 32, 34.

When the carrier device 20 is manufactured, the carrier device 20 is integrally attached to other like carrier devices before being separated into an individual carrier device. The outermost ends 70 of the handle portion 68 and the straight portions 50 of the side margins 44, 46 of the container engaging portions 32, 34 provide attachment regions for attaching adjacent interconnected like carrier devices thereto. This allows a plurality of flat carrier devices 20 to be easily handled. When the carrier devices 20 are flat and are attached to each other, the carrier devices 20 can be wound onto a reel into a roll or otherwise easily handled. To form an individual carrier device 20, the carrier devices are cut apart from each other by suitable means.

Because the joined portion 48 is continuous along its length, handling and winding problems have been reduced. Because there is not a discontinuous edge along the length of the joined portion 48, the carrier devices 20 do not interlock with each other when the carrier devices 20 are wound on the reel or roll.

The carrier device 20 of the present invention presents several other advantages. For example, the carrier device 20 is sturdy while allowing a consumer to easily carry the package 24. In addition, the carrier device 20 of the present invention can be manufactured at a low cost.

While a preferred embodiment of the present invention is shown and described, it is envisioned that those skilled in the art may devise various modifications of the present invention without departing from the spirit and scope of the appended claims.

The invention claimed is:

1. A carrier device for carrying containers comprising: first and second container engaging portions each formed from a sheet of plastic material, each said container engaging portion including a plurality of bands, each said band defining an aperture for securely holding a single container therein, each said container engaging portion having a top margin and opposite side margins, said side margins defining the outermost extents of said container engaging portions; a joined portion at said top margins of said container engaging portions which is formed by bonding said top margins of said container engaging portions together for joining said container engaging portions together such that said container engaging portions freely extend from said joined portion, said joined portion having a predetermined length and opposite ends; and a notch portion along at least one of said side margins of each said container engaging portion, said at least one side margin having a side margin edge having said notch portion thereon, said notch portion being defined by first and second edges, said first edge tapering inwardly from the outermost extent of said side margin edge and being proximate to said joined portion for providing a stress relief for the end of said joined portion proximate to said notch portion by said notch portion being capable of generally straightening relative to said side margin edge when said container engaging portions are assembled over the containers.

2. A carrier device as defined in claim 1, further including a plurality of cutouts in said container engaging portions and proximate to said joined portion and spaced apart from each other along the length of the joined portion, said cutouts contracting when said container engaging portions are stretched over the containers.

3. A carrier device as defined in claim 2, wherein said joined portion is continuous along its length.

4. A carrier device for carrying containers comprising: first and second container engaging portions each formed from a sheet of plastic material, each said container engaging portion having a top margin and opposite side margins said side margins defining the outermost extents of said container engaging portions, each said container engaging portion having a plurality of bands defining apertures therein, each said band for holding a single container therein, a joined portion at said top margins of said container engaging portions which is formed by bonding said top margins of said container engaging portions together for joining said container engaging portions together such that said container engaging portions freely extend from said joined portion, said joined portion having a predetermined length and opposite ends and being continuous along its length and extends from one side margin of each container engaging portion to the opposite side margin of each container engaging portion, and a plurality of cutouts in said container engaging portions and proximate to said joined portion and spaced along the length of the joined portion, said cutouts contracting when said container engaging portions are stretched over the containers.

5. A carrier device as defined in claim 4, wherein each said cutout has edges that extend from spaced points along the joined portion.

6. A carrier device as defined in claim 5, wherein each said cutout is between adjacent apertures in said container engaging portions.

7. A carrier device as defined in claim 4, wherein each of said container engaging portions has opposite side margins which define the outermost extents of said container engaging portions, and further including a notch portion along at least one of said side margins of each said container engaging portion proximate to said joined portion for providing a stress relief for the end of said joined portion proximate to said notch portion when said container engaging portions are assembled over the containers.

8. A carrier device as defined in claim 7, wherein each said notch portion is defined by at least one edge which tapers inwardly from the outermost extent of said respective side margin.

9. A carrier device for carrying containers comprising: first and second container engaging portions each formed from a sheet of plastic material, each of said container engaging portions having a top margin, opposite side margins which define the outermost extents of said container engaging portions and a plurality of bands defining apertures therein, each said band for holding a single container therein, a joined portion at said top margins of said container engaging portions which is formed by bonding said top margins of said container engaging portions together for joining said container engaging portions together such that said container engaging portions freely extend from said joined portion, said joined portion having a predetermined length and opposite ends and being continuous along its length, and a notch portion along at least one of said side margins of each said container engaging portion, said at least one side margin having a side margin edge having said notch portion thereon, said notch portion being defined by first and second edges, said first edge tapering inwardly from the outermost extent of said side margin edge and being proximate to said joined portion for providing a stress relief for the end of said joined portion proximate to said notch portion by said notch portion being capable of generally straightening relative to said side margin edge when said container engaging portions are assembled over the containers.

* * * * *